US006176126B1

(12) United States Patent
Tsuruga et al.

(10) Patent No.: US 6,176,126 B1
(45) Date of Patent: Jan. 23, 2001

(54) ENGINE SPEED CONTROL SYSTEM FOR CONSTRUCTION MACHINE

(75) Inventors: Yasutaka Tsuruga, Ryugasaki; Kenichiro Nakatani; Junya Kawamoto, both of Tsuchiura; Takashi Kanai, Chiba-ken, all of (JP)

(73) Assignee: Hitachi Construction Machinery Co., Ltd., Tokyo (JP)

( * ) Notice: Under 35 U.S.C. 154(b), the term of this patent shall be extended for 0 days.

(21) Appl. No.: 09/321,217

(22) Filed: May 27, 1999

(30) Foreign Application Priority Data

May 28, 1998 (JP) ..... 10-147505

(51) Int. Cl.[7] ..... G01M 15/00; B60K 31/00

(52) U.S. Cl. ..... 73/118.1; 60/431; 123/319

(58) Field of Search ..... 73/116, 117.2, 73/117.3, 118.1; 123/319, 339.1, 339.14, 339.16, 339.18; 60/431, 433, 445, 449

(56) References Cited

U.S. PATENT DOCUMENTS 4,549,400 * 10/1985 King ..... 60/431
4,588,357 * 5/1986 McGraw et al. ..... 60/431
4,942,737 * 7/1990 Tatsumi ..... 60/431
5,214,916 * 6/1993 Lukich ..... 60/431
5,277,269 * 1/1994 Ichimura et al. .
5,477,679 * 12/1995 Tatsumi et al. ..... 60/431
5,638,677 * 6/1997 Hosono et al. ..... 60/431
6,105,367 * 8/2000 Tsuruga et al. ..... 60/445

FOREIGN PATENT DOCUMENTS 3-52284 11/1991 (JP) .

* cited by examiner

*Primary Examiner*—Eric S. McCall
(74) *Attorney, Agent, or Firm*—Evenson, McKeown, Edwards & Lenahan, P.L.L.C.

(57) ABSTRACT

An engine speed control system for a construction machine is arranged in association with its hydraulic circuit, which has main pumps, a communication line through which input ports of travel-controlling directional control valves are connected with each other, and a travel-controlling communication valve arranged in the communication line. The engine speed control system is provided with pilot valves arranged in a pilot line to control traveling, pilot valves arranged in a pilot line to control booms and the like, pilot valves arranged in a pilot line to control revolving, earth moving and the like, a pressure sensor for detecting pressures in the pilot lines, another pressure sensor for detecting a pressure in the pilot line, an engine controller for performing automatic idling control or its cancellation in accordance with signals from the pressure sensors, and a signal line for changing over the travel-controlling communication line into a communicating position in response to a pressure in the pilot valve.

7 Claims, 3 Drawing Sheets

ENGINE SPEED CONTROL SYSTEM FOR CONSTRUCTION MACHINE

BACKGROUND OF THE INVENTION a) Field of the Invention

This invention relates to an engine speed control system for a construction machine such as a hydraulic excavator, which is suitable for arrangement in the construction machine and, when directional control valves for controlling drive of actuators are all held in center valve positions thereof, can perform automatic idling control such that the speed of an engine is maintained at an idling speed of a predetermined low rpm.

b) Description of the Related Art

As prior art of this type, there is one disclosed in Japanese Utility Model Publication (Kokoku) No. HEI 3-52284. FIG. 3 is a hydraulic circuit diagram illustrating this conventional engine speed control system as arranged in a construction machine.

The conventional engine speed control system is arranged in association with a hydraulic circuit of the construction machine. The hydraulic circuit is provided with an engine 40, plural main hydraulic pumps driven by the engine 40, specifically a first main pump 41 and a second main pump 42, plural actuators driven by pressure fluid supplied from these first main pump 41 and second main pump 42, respectively, specifically hydraulic system actuators 55–58, 62,63, directional control valves connected with the first main pump 41 to control flows of pressure fluid to be supplied to their corresponding hydraulic system actuators 55–58 from the first main pump 41, specifically change-over control valves 51–54, directional control valves connected with the second main pump 42 to control flows of pressure fluid to be supplied to the corresponding hydraulic system actuators 62,63,58 from the second main pump 42, specifically change-over control valves 59–61, and a reservoir 77.

Of the above-mentioned hydraulic system actuators 55–58,62,63, the hydraulic system actuator 55 constitutes one of a pair of travel motors, the hydraulic system actuator 62 constitutes the other travel motor, and the hydraulic system actuators 56,57,58,63 constitute actuators other than those mentioned above.

As has been mentioned above, the hydraulic actuator 55 which constitutes the one travel motor is connected with the first main pump 41, while the hydraulic actuator 62 which constitutes the other travel motor is connected with the second main pump 42.

The conventional engine speed control system arranged in association with the hydraulic circuit as described above is provided with an engine control mechanism, which performs automatic idling control to set the speed of the engine 40 at an idling speed of a predetermined low rpm and can also perform control to cancel the above-mentioned automatic idling control. This engine control mechanism comprises, for example, a speed governor 67 which in turn, is equipped inter alia with a governor lever 69 for controlling a quantity of fuel to be injected and a spring 68 by which the governor lever 69 is biased.

The conventional engine speed control system is also provided with a pilot pump 64 capable of supplying a pilot pressure, a pilot line 65 for guiding the pilot pressure supplied from the pilot pump 64, pilot valves 70–76 arranged independently in the pilot line 65 in association with the above-mentioned change-over control valves 51–54,59–61, respectively, such that the pilot valves are operated in association with their corresponding change-over control valves, and a pressure detection device for detecting a pressure developed in the pilot line 65 upon change-over of at least one of these pilot valves 70–76 and then outputting it as a detection signal to the above-mentioned speed governor 67, for example, a line 78.

When the change-over control valves 51–54,59–61 are all held in their center positions, for example, as shown in FIG. 3, the pilot line 65 is in communication with the reservoir 77 so that the pilot line 65 has the reservoir pressure. This reservoir pressure is supplied to the speed governor 67 via the line 78. By the force of the spring 68 which is greater than the force of the reservoir pressure, the governor lever 69 assumes a position "a" in FIG. 3. As a consequence, the speed of the ending 40 is maintained at an idling speed of a predetermined low rpm, thereby realizing a reduction in fuel consumption.

Let's assume that, to drive one of the hydraulic system actuators 55–58,62,63, for example, the corresponding one of the change-over control valves 51–54,59–61 is operated. One of the pilot valves 70–76, said one pilot valve corresponding to the operated change-over control valve, is changed over concurrently and as a consequence, a pressure is developed in the pilot line 65 at a part between the change-over control valve 74, which is arranged on a most upstream side in the pilot line 65, and the pilot pump 64. This pressure is supplied to the governor 67 via the line 78, so that the spring 68 is compressed and the governor lever 69 assumes a position "b" in FIG. 3. Accordingly, control is performed to cancel the control that the engine speed be maintained at the idling speed as mentioned above, namely, the automatic idling control. As a result, the engine 40 can be driven at a desired rpm, for example, a rated rpm or the like.

In the above-described conventional art, the change-over control valve 51 for controlling drive of the hydraulic actuator 55, which constitutes the one travel motor, and the change-over control valves 52–54 for controlling drive of the hydraulic system actuators 56–58, which constitute the plural other actuators, are connected to the first main pump 41, whereas the change-over control valve 59 for controlling drive of the hydraulic system actuator 62, which constitutes the other travel motor, and the change-over control valves 60,61 for controlling drive of the hydraulic system actuators 63,58, which constitute the other actuators, are connected to the second main pump 42.

Accordingly, upon single operation of travelling, the pressure fluid delivered from the first main pump 41 is supplied to the change-over control valve 51 for the hydraulic system actuator 55 and the pressure fluid delivered from the second main pump 42 is supplied to the change-over control valve 59 for the hydraulic system actuator 62, so that the single operation of travelling can be performed as desired.

However, when it is desired to perform, for example, a combined operation of travelling and another operation, which is to be performed by driving the hydraulic system actuator 56, from the state of such a single operation of travelling, the pressure fluid delivered from the first main pump 41 is supplied to both of the change-over control valve 51 for the hydraulic system actuator 55, which constitutes the one travel motor, and the change-over control valve 52 for the hydraulic system actuator 56, while the pressure fluid delivered from the second main pump 42 is supplied only to the change-over control valve 59 for the hydraulic system actuator 62 which constitutes the other travel motor. During such a combined operation of travelling and another operation by another actuator, it is therefore impossible to assure independence for the travelling, leading to a potential problem that the construction machine may be caused to travel in a zigzag.

SUMMARY OF THE INVENTION

With the foregoing problem of the conventional art in view, the present invention has as an object thereof the provision of an engine speed control system for a construction machine, which makes it possible to assure independence of travelling while enabling to achieve automatic idling control to automatically set an engine speed at a predetermined low rpm and cancellation of the automatic idling control.

To attain the above-described object, the present invention provides, in a first aspect thereof, an engine speed control system for a construction machine, said system being for arrangement in association with a hydraulic circuit of the construction machine, said hydraulic circuit being provided with an engine, plural main hydraulic pumps driven by the engine, plural actuators driven by hydraulic fluid supplied from the main hydraulic pumps, and directional control valves for controlling flows of the hydraulic fluid to be supplied from the main hydraulic pumps to the actuators, respectively, in which:

the plural actuators comprises a pair of travel motors and plural other actuators different from the travel motors, the directional control valves comprises a first directional control valve for controlling drive of one of the pair of travel motors, a second directional control valve for controlling drive of the other one of the pair of travel motors and plural third directional control valves for controlling drive of the plural other actuators, predetermined ones of the first directional control valve and plural third directional control valves are connected to a first one of the plural main hydraulic pumps, and other ones of the second directional control valve and plural third directional control valves are connected to a second one of the plural main hydraulic pumps, said system being provided with an engine controller capable of controlling a speed of the engine, a pilot pump capable of supplying a pilot pressure, a pilot line for guiding the pilot pressure supplied from the pilot pump, pilot valves arranged in the pilot line in association with the directional control valves, respectively, such that the pilot valves are operated association with their corresponding directional control valves, and a pressure detection device for detecting a pressure developed in the pilot line upon change-over of at least one of the pilot valves and then outputting a detection signal to the engine controller, whereby based on the detection signal outputted from the pressure detection device, the engine controller performs automatic idling control to maintain the speed of the engine at an idling speed of a predetermined low rpm or performs control to cancel the automatic idling control, wherein:

the hydraulic circuit of the construction machine is provided further with a communication line, through which an input port of the first directional control valve and an input port of the second directional control valve are connected with each other, and also with a travel-controlling communication valve capable of maintaining the communication line in either a communicating state or a cutoff state, the pilot line comprises a first pilot line and a second pilot line, the first pilot line is provided with the pilot valve operable in association with the first directional control valve and also with the pilot valve operable in association with the second directional control valve, the second pilot line is provided with the pilot valves operable in association with their corresponding ones of the plural third directional control valves for controlling the drive of the plural other actuators, respectively, a signal line for guiding a pressure, which is developed in the second pilot line, as a change-over pressure for the travel-controlling communication valve, and the travel-controlling communication valve has a changed-over position where, when the change-over pressure is guided to the signal line, the communication line is maintained in the communicating state.

According to the first aspect of the present invention constructed as described above, pressure rises neither in the first pilot line nor in the second pilot line when all the directional control valves are held in their center positions, for example. This is detected by the pressure detection device, and responsive to this detection, the engine controller performs automatic idling control to maintain the speed of the engine at the idling speed of the predetermined low rpm.

Let's assume that to perform a straight advance travelling operation, for example, the first directional control valve and the second directional control valve are both controlled from the state in which all the directional control valves are held in their center positions as described above. Then, pressure fluid delivered from the first main pump from the first main pump is supplied to the first directional control valve and pressure fluid delivered from the second main pump is supplied to the second directional control valve. As a result, the pressure fluids are supplied to the travel motors arranged in the pair, respectively, thereby making it possible to perform the straight advance travelling operation as desired, that is, a single operation of travelling.

At this time, with the change-over of the pilot valves operated in association with the first directional control valve and the second directional control valve, respectively, a pressure rises in the first pilot line but no pressure rises in the second pilot line. No change-over pressure is therefore guided to the travel-controlling communication valve via the signal line, so that the travel-controlling communication valve maintains the communication line in a cutoff state.

Incidentally, the rise of the pressure in the first pilot line is detected at this time by the pressure detection device and a detection signal is outputted to the engine controller, as described above. As a consequence, the engine controller cancels the above-mentioned automatic idling control and performs control to set the engine speed at a desired rpm suitable for straight advance travelling operation.

When another actuator is driven to perform another operation, for example, in combination with such a travelling operation as mentioned above, in other words, when it is desired to perform a combined operation including travelling, the first directional control valve, the second directional control valve, and the third directional control valve for this another actuator are controlled. At this time, with the change-over of the pilot valves operated in association with the first directional control valve and the second directional control valve, a pressure rises in the first pilot line as mentioned above, and with the change-over of the pilot valve operated in association with the third directional control valve for the another actuator, a pressure also rises in the second pilot line as mentioned above. The rise of these pressures in the first and second pilot lines is detected by the pressure detection device, and a detection signal is then outputted to the engine controller. Responsive to the detection signal, the engine controller keeps the above-mentioned automatic idling control canceled, and performs control to set the speed of the engine at a desired rpm suitable for the combined operation including the travelling.

At this time, the pressure developed in the second pilot line is supplied as a change-over pressure to the travel-controlling communication valve via the signal line, whereby the travel-controlling communication valve is changed over such that the communication line is brought into a communicating state. As a consequence, the input port of the first directional control valve and that of the second directional control valve are communicated with each other via the communication line.

The pressure fluid delivered, for example, from the first main pump is supplied to the first directional control valve, and is also supplied to the second directional control valve via the communication line and the travel-controlling communication valve. On the other hand, the pressure fluid delivered from the second main pump is supplied to the third directional control valve for the another actuator. Namely, the pressure fluid delivered from the first main pump is supplied to the pair of travel motors via the first directional control valve and the second directional control valve, respectively, thereby making it possible to perform the desired travelling operation. On the other hand, the pressure fluid delivered from the second main pump is supplied to the another actuator via the corresponding third directional control valve so that by the resulting drive of this another actuator, the corresponding operation can be performed. The combined operation including the desired travelling can therefore be achieved, with independence being assured for the travelling.

The present invention, in a second aspect thereof, is constructed such that in the first aspect, the system further comprises a higher pressure selection device capable of selecting higher one of a pressure in the first pilot line, and a pressure in the second pilot line and the pressure detection device detects a pressure outputted from the higher pressure selection device.

According to the second aspect of the present invention constructed as described above, when upon single operation of travelling, at least one of the first and second directional control valves is operated to change over the corresponding pilot valve and a pressure hence rises in the first pilot line, when upon combined operation including travelling, at least one of the first and second control valves is operated to change over the corresponding pilot valve and a pressure hence rises in the second pilot line and at the same time, the third directional control valve for the another actuator is operated to change over the corresponding pilot valve and a pressure hence rises in the second pilot line, or when upon single operation of one of the other actuators or combined operation of two or more actuators out of the other actuators, the third actuator or actuators for the one, two or more of the other actuators are operated to change over the corresponding pilot valve or valves and a pressure hence rises in the second pilot line, the above-mentioned pressure is selected by the higher pressure selection device, the thus-selected pressure is detected by the pressure detection device, and a detection signal is supplied to the engine controller. Responsive to this detection signal, the engine controller performs control to cancel the automatic idling control.

The present invention, in a third aspect thereof, is constructed such that in the first or second aspect, the plural other actuators comprise a first boom cylinder, a second boom cylinder, a bucket cylinder and an arm cylinder, the plural third directional control valves comprise a first-boom-controlling directional control valve for controlling drive of the first boom cylinder, a second-boom-controlling directional control valve for controlling drive of the second boom cylinder, a bucket-controlling directional control valve for controlling drive of the bucket cylinder, and an arm-controlling directional control valve for controlling drive of the arm cylinder, the first-boom-controlling directional control valve and the bucket-controlling directional control valve are connected to the first main pump, and the second-boom-controlling directional control valve and the arm-controlling directional control valve are connected to the second main pump.

Further, the present invention, in a fourth aspect thereof, is constructed such that in any one of the first to third aspects, the plural main pumps further comprise a third main pump, the plural other actuators further comprise a revolving motor driven by pressure fluid delivered from the third main pump, and the plural third directional control valves further comprise a revolving-motor-controlling directional control valve for controlling drive of the revolving motor, and the pilot line further comprises a third pilot line, and is additionally provided with a pilot valve arranged in the third pilot line such that the pilot valve is operated in association with the revolving-motor-controlling directional control valve and also with an additional pressure detection device for detecting a pressure, which is developed in the third pilot line upon change-over of the pilot valve, and then outputting the pressure as a detection signal to the engine controller.

According to the fourth aspect of the present invention constructed as described above, the revolving motor is connected to the third main pump so that upon combined operation of revolving and an operation of another actuator, including travelling, independence can be assured for the revolving by supplying the pressure fluid, which is delivered from the third main pump, to the revolving motor.

Further, when the revolving-controlling directional control valve is operated to drive the revolving motor, the corresponding pilot valve is changed over and a pressure rises in the third pilot line. This pressure is detected by the pressure detection device and a detection signal is supplied to the engine controller. Responsive to the detection signal, the engine controller cancels the automatic idling control and sets the speed of the engine at a rpm suitable for the operation including the revolving operation.

The present invention, in a fifth aspect thereof, is constructed such that in the fourth aspect, the plural other actuators further comprise a blade-driving cylinder, and the plural third directional control valves further comprise a blade-controlling directional control valve for controlling drive of the blade-driving cylinder, and the blade-controlling directional control valve is connected to the third main pump.

According to the fifth aspect of the present invention constructed as described above, the blade-driving cylinder is connected to the third main pump so that upon combined operation of an earth-moving operation and an operation of another actuator, including travelling, independence is assured for the earth-moving operation by supplying the pressure fluid, which is delivered from the third main pump, to the blade-driving cylinder.

Further, when the blade-controlling directional control valve is operated to actuate the blade-driving cylinder, the corresponding pilot valve is changed over and a pressure hence rises in the third pilot line. This pressure is detected by the pressure detection device and a detection signal is supplied to the engine controller. Responsive to the detection signal, the engine controller cancels the automatic idling control and sets the speed of the engine at a rpm suitable for the operation including the earth-moving operation.

The present invention, in a sixth aspect thereof, is constructed such that in the fourth or fifth aspect, the plural other actuators further comprise an offset cylinder, and the plural third directional control valves further comprise an offset-cylinder-controlling directional control valve for controlling drive of the offset cylinder, and the offset-cylinder-controlling directional control valve is connected to the third main pump.

According to the sixth aspect of the present invention constructed as described above, the offset cylinder is connected to the third main pump so that upon combined operation of an offsetting operation and an operation of another actuator, including travelling, independence is assured for the offsetting operation by supplying the pressure fluid, which is delivered from the third main pump, to the offset cylinder.

Further, when the offset-cylinder-controlling directional control valve is operated to actuate the offset cylinder, the corresponding pilot valve is changed over and a pressure hence rises in the third pilot line. This pressure is detected by the pressure detection device and a detection signal is supplied to the engine controller. Responsive to the detection signal, the engine controller cancels the automatic idling control and sets the speed of the engine at a rpm suitable for the operation including the offsetting operation.

Moreover, each of the above-described aspects of the present invention is suited especially for hydraulic excavators out of construction machines.

DESCRIPTION OF THE PREFERRED EMBODIMENT

Figure 1:
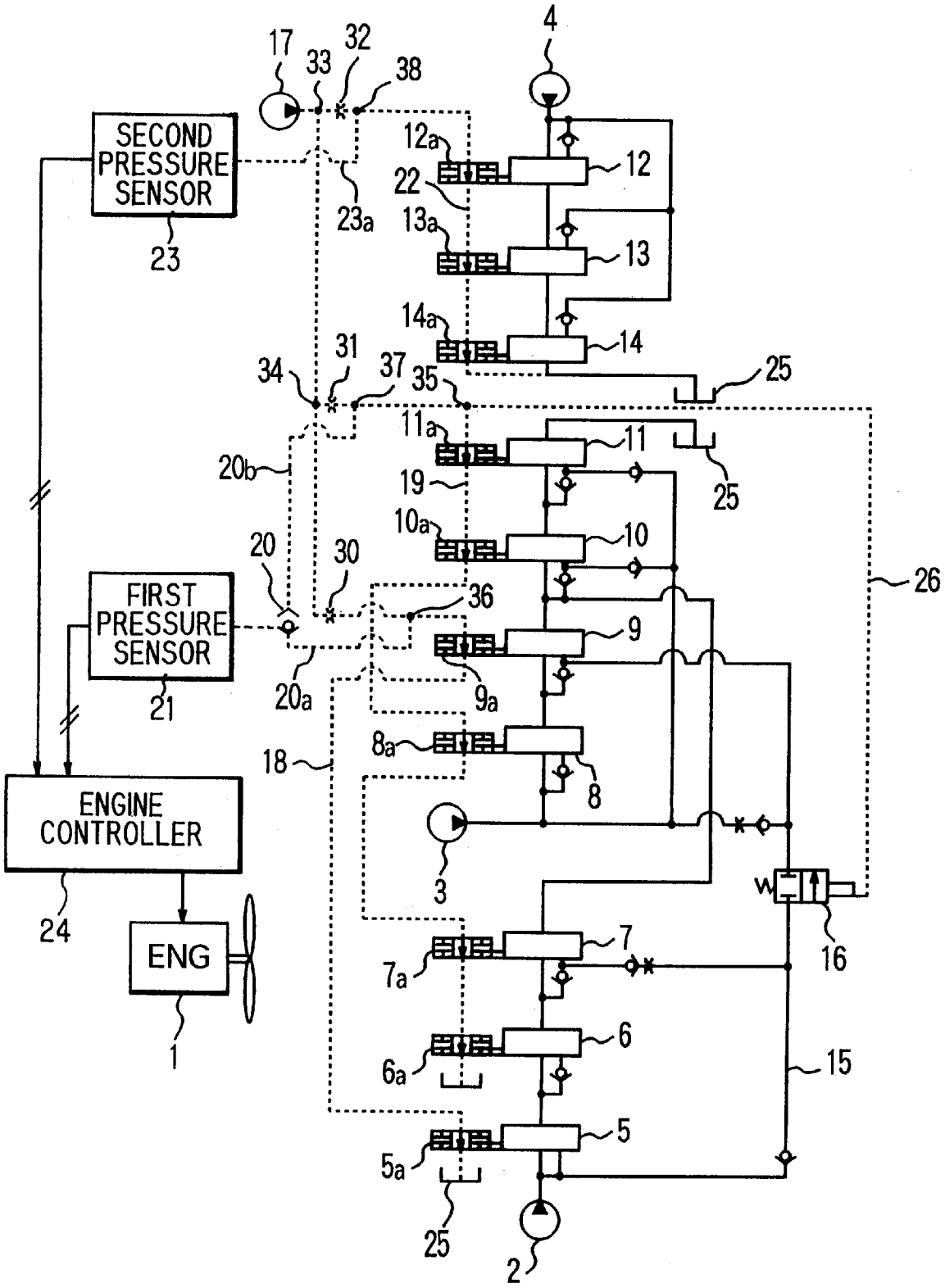
FIG. 1 is a hydraulic circuit illustrating one embodiment of the engine speed control system according to the present invention for a construction machine.

The embodiment of the engine speed control system according to the present invention for the construction machine will hereinafter be described with reference to FIGS. 1 and 2 of the accompanying drawings.

This embodiment can be arranged, for example, in a hydraulic excavator. As is illustrated in FIG. 1, a hydraulic circuit of the hydraulic excavator in which this embodiment can be arranged is provided with an engine 1, and plural main hydraulic pumps driven by the engine 1, for example, a first main pump 2, a second main pump 3, and a third main pump 4.

To the first main pump 2, a first directional control valve for controlling a flow of pressure fluid to be supplied to one of unillustrated travel motors arranged in a pair, that is, a directional control valve 5 for a left travel motor is connected on a most upstream point, and on a downstream side of the directional control valve 5 for the left travel motor, a first boom-controlling directional control valve 6 for controlling a flow of pressure fluid to be supplied to an unillustrated boom cylinder is connected in tandem with the directional control valve 5. In parallel with the directional control valve 6, a bucket-controlling directional control valve 7 for controlling a flow of fluid pressure to be supplied to an unillustrated bucket cylinder is also connected to the first main pump 2.

To the second main pump 3, a second boom-controlling directional control valve 8 for controlling a flow of pressure fluid to be supplied to the above-mentioned boom cylinder is connected at a most upstream point, and to this second boom-controlling directional control valve 8, a second directional control valve for controlling a flow of pressure fluid to be supplied to the other one of the unillustrated travel motors arranged in the pair, that is, a directional control valve 9 for a right travel motor is connected. Further, an arm-controlling directional control valve 10 for controlling a flow of pressure fluid to be supplied to an unillustrated arm cylinder and a directional control valve 11 for a reserve actuator are connected in parallel with each other to the second main pump 3. Incidentally, the above-mentioned bucket-controlling directional control valve 7 is communicated at a downstream side thereof to an input port of the arm-controlling directional control valve 10.

To the third main pump 4, a blade-controlling directional control valve 12 for controlling a flow of pressure fluid to be supplied to an unillustrated blade-driving cylinder which is used in earth-moving operations, a revolving-controlling directional control valve 13 for controlling a flow of pressure fluid to be supplied to an unillustrated revolving motor and an offset-controlling directional control valve 14 for controlling a flow of pressure fluid to be supplied to an unillustrated offset cylinder are connected in parallel with each other.

A communication line 15 is also arranged to connect an input port of the directional control valve 5 for the left travel motor and the input port of the directional control valve 10 for the right travel motor with each other. Also arranged is a travel-controlling communication valve 16 having a changed-over position at which the communication line 15 is held in either a communicating state or a cutoff state. Incidentally, designated at numeral 25 in FIG. 1 is a reservoir.

The engine speed control system according to this embodiment is for arrangement in association with the hydraulic circuit of the hydraulic excavator as mentioned above, and is provided with an engine controller 24 which performs automatic idling control to set the speed of the engine 1 at an idling speed of a predetermined low rpm and which also performs control to cancel the automatic idling control. The engine controller 24 serves to output an electrical signal for controlling, for example, the engine speed, and is equipped with a built-in OR circuit 24*a* as shown in FIG. 2.

Also arranged are a pilot pump 17 capable of supplying a pilot pressure, a first pilot line 18 connected at a node 33 to a delivery line of the pilot pump 17 and adapted to guide a pilot pressure supplied from the pilot pump 17, a second pilot line 19 connected at a node 34 to the first pilot line 18 and adapted to guide a pilot pressure supplied from the pilot pump 17, and a third pilot line 22 connected at the node 33 to the first pilot line 18 and adapted to guide a pilot pressure supplied from the pilot pump 17.

The above-mentioned first pilot line 18 is provided with a pilot valve 5*a* operable in association with the directional control valve 5 for the left travel motor to selectively communicate or cut off the first pilot line 18 and also with a pilot valve 9*a* operable in association with the directional control valve 9 for the right travel motor to selectively communicate or cut off the first pilot line 18.

The above-mentioned second pilot line 19 is provided with a pilot valve 6*a* operable in association with the first boom-controlling directional control valve 6 to selectively communicate or cut off the second pilot line 19, a pilot valve 7*a* operable in association with the bucket-controlling directional control valve 7 to selectively communicate or cut off the second pilot line 19, a pilot valve 8*a* operable in association with the second boom-controlling directional control valve 8 to selectively communicate or cut off the second pilot line 19, a pilot valve boa operable in association with the arm-controlling directional control valve 10 to selectively communicate or cut off the second pilot line 19, and a pilot valve 11*a* operable in association with the directional control valve 11 for the reserve actuator to selectively communicate or cut off the second pilot line 19.

The third pilot line 22 is provided with a pilot valve 12*a* operable in association with the blade-controlling directional control valve 12 to selectively communicate or cut off the third pilot line 22, a pilot valve 13*a* operable in association with the revolving-controlling directional control valve 13 to selectively communicate or cut off the third pilot line 22, and a pilot valve 14*a* operable in association with the offset-controlling directional control valve 14 to selectively communicate or cut off the third pilot line 22.

Further, a signal line 26 through which a pressure developed in the second pilot line 19 is guided as a change-over pressure for the travel-controlling communication valve 16 is connected at a node 35 to the second pilot line 19.

The first pilot line 18 is provided with a restrictor 30 at a part of the first pilot line 18 located between the node 34 on the first pilot line 18 and the pilot valve 9*a* for the directional control valve 9 for the right travel motor, and a line 20*a* is connected to a node 36 on the first pilot line 18, said node 36 being located between the restrictor 30 and the pilot valve 9*a*.

The second pilot line 19 is provided with a restrictor 31 at a part of the second pilot line 19 located between the node 34 and the node 35, and a line 20*b* is connected to a node 37 on the second pilot line 19, said node 37 being located between the restrictor 31 and the node 35.

Also arranged are a higher pressure selection means for selecting the greater one of the above-mentioned pressures in the lines 20*a*,20*b*, for example, a shuttle valve 20 and further, a first pressure sensor 21 for detecting a pressure outputted from the shuttle valve 20 and outputting an electrical signal, i.e., a detection signal to the OR circuit 24*a* of the above-mentioned engine controller 24.

Figure 2:
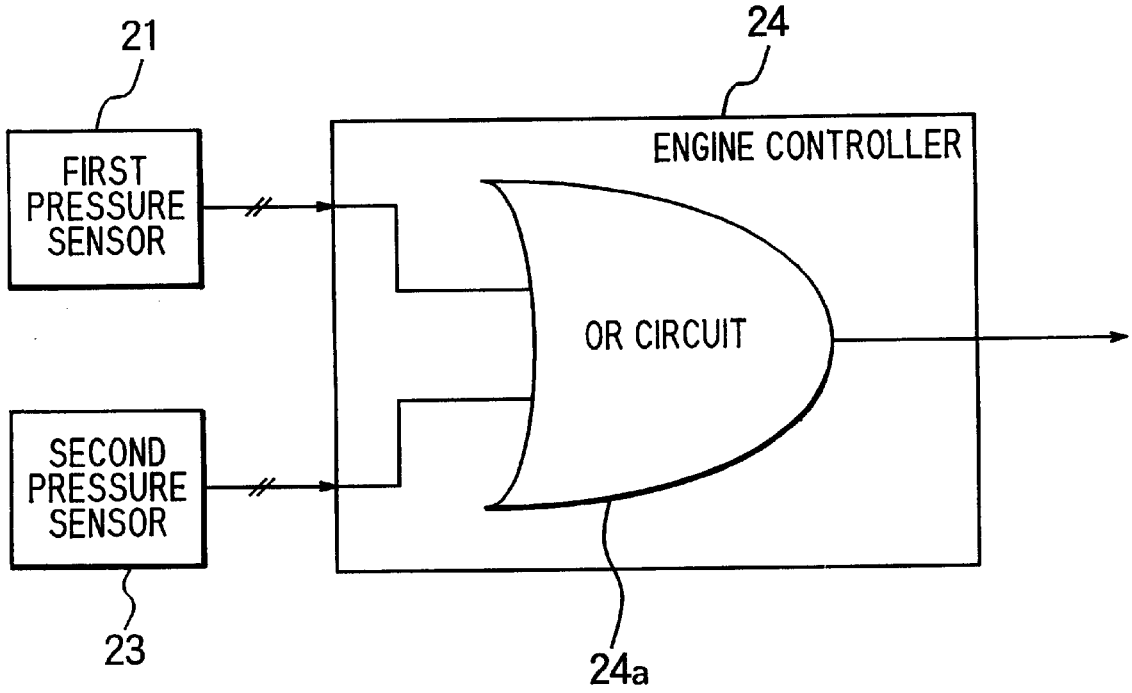
FIG. 2 is a fragmentary block diagram of an engine controller arranged in the embodiment illustrated in FIG. 1.
Figure 3:
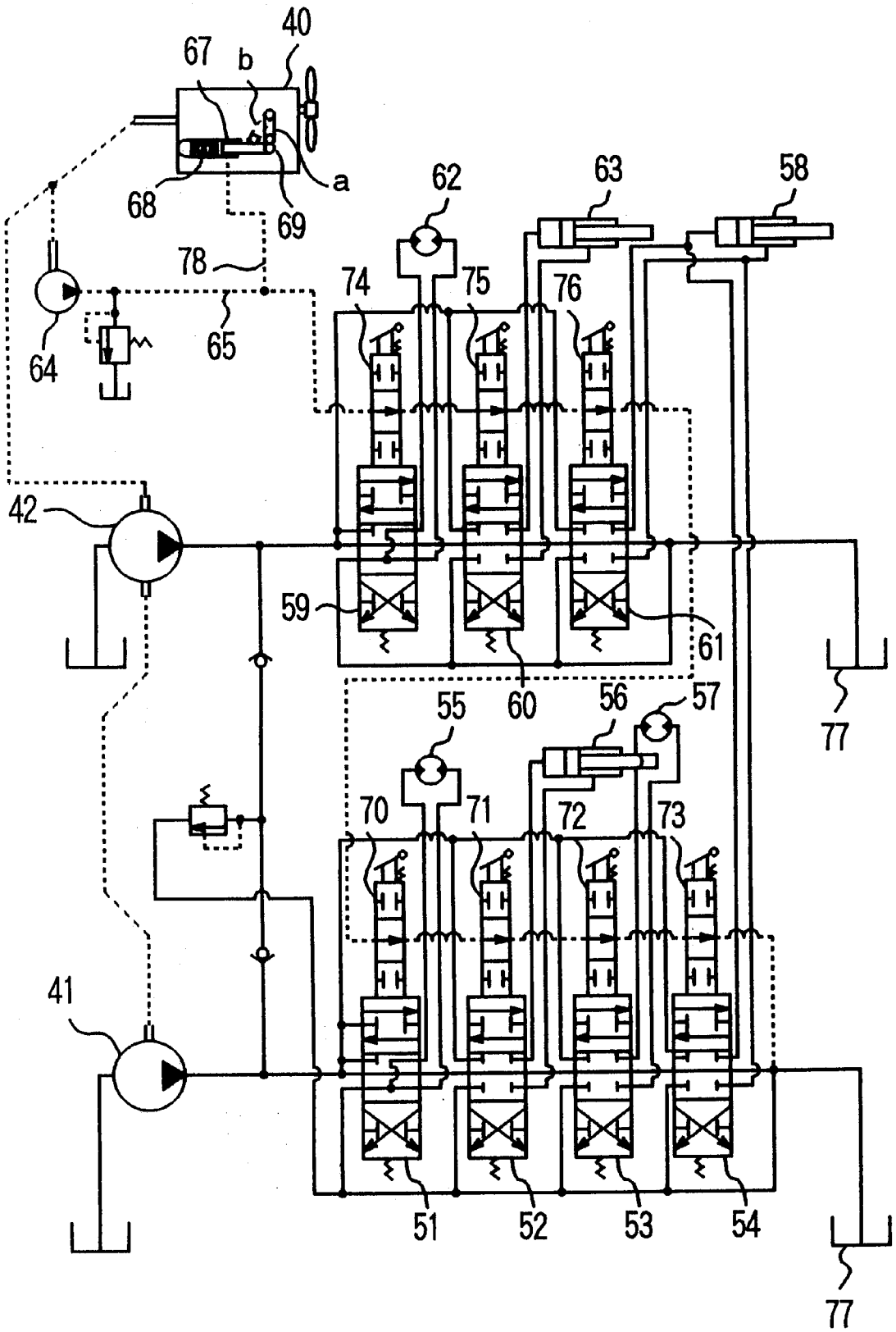
FIG. 3 PRIOR ART
FIG. 3 is the hydraulic circuit depicting the conventional engine speed control system for the construction machine.

Moreover, the third pilot line 22 is provided with a restrictor 32 at a part of the third pilot line 22 located between the node 33 and the node 38 in FIG. 1, and a line 23*a* is connected to a node 38 on the third pilot line 2, said node 38 being located between the restrictor 32 and the pilot valve 12 for the blade-controlling directional control valve 12. Also arranged is a second pressure sensor 23 which detects a pressure in the line 23*a* and outputs an electrical signal or a detection signal to the OR circuit 24*a* of the above-mentioned engine controller 24.

Operation of the embodiment constructed as described above will hereinafter be described.

(1) When all the directional control valves are in their center positions:

When all the directional control valves 5–14 are held in their center positions as illustrated in FIG. 1, the pilot valves 5*a*–14*a* which are operable in association with these directional control valves 5–14 are also held in their center positions, in other words, in positions where the first, second and third pilot lines 18,19,22 are maintained in communicating states, respectively. Accordingly, a pressure supplied to the shuttle valve 20 through the first pilot line 18 and the line 20*a* and a pressure supplied to the shuttle valve 20 through the second pilot line 19 and the line 20*b* both become substantially equal to a reservoir pressure, and this low pressure is detected by the first pressure sensor 21 and is then outputted to the OR circuit 24*a* (see FIG. 2) of the engine controller 24. Likewise, a pressure which is substantially equal to the reservoir pressure is detected by the second pressure sensor 23 through the third pilot line 22 and the line 23*a*, and is outputted to the OR circuit 24*a* of the engine controller 24. As the detection signals outputted from the respective pressure sensors 21,23 are those indicating that all the directional control valves 5–14 are in their center positions, automatic idling control is performed to set the engine speed at a predetermined low rpm.

(2) Single operation of travelling:

Let's assume that to perform straight advance travelling (straight advance), for example, the directional control valve 5 for the left travel motor and the directional control valve 9 for the right travel motor are operated from their center positions mentioned above under (1). The pilot valves 5*a*,9*a* are then changed over in association with the directional control valves 5,9. Responsive to these change-over operations, a pressure rises in the part of the first pilot line 18, which is located between the restrictor 30 and the pilot valve 9*a* in FIG. 1. This pressure is detected by the first pressure sensor 21 via the shuttle valve 20, and is outputted as a detection signal to the OR circuit 24*a* of the engine controller 24.

Responsive to the detection signal, the engine controller 24 performs control to cancel the automatic idling control which has been performed until that time. As a consequence, the speed of the engine 1 increases to a rpm suitable for the straight advance travelling operation.

During these operations, no pressure is developed at the node 35 on the second pilot line 19. The travel-controlling communication valve 16 is therefore held in the cutoff position as shown in FIG. 1 without supplying any cut-off pressure to the travel-controlling communication valve 16 via the signal line 26. As a consequence, the pressure fluid of the first main pump 2 is supplied to the unillustrated left travel motor via the directional control valve 5 for the left travel motor, and the pressure fluid of the second main pump 3 is supplied to the unillustrated right travel motor via the directional control valve 9 for the right travel motor, so that the straight advance travelling is performed as desired.

Incidentally, for example, operation of only one of the directional control valve 5 for the left travel motor and the directional control valve 9 for the right travel motor makes it possible to perform turning or the like, and operation of both of the directional control valve 5 for the left travel motor and the directional control valve 9 for the right travel motor in directions to the above-mentioned directions makes it possible to make a backward movement.

(3) Single operation involving drive of another actuator such as operation of boom, arm or the like, or a combined operation of such other actuators.

Let's assume that to perform a single operation of boom raising, for example, the first boom-controlling directional control valve 6 and the second boom-controlling directional control valve 8 are operated from their center positions mentioned above under (1). The pilot valves 6*a*,8*a* are then changed over in association with the directional control valves 6,8. Responsive to these change-over operations, a pressure rises in the part of the second pilot line 19, which is located downstream of the restrictor 31 in FIG. 1. This pressure is detected by the first pressure sensor 21 via the line 20*b* and the shuttle valve 20, and is outputted as a detection signal to the OR circuit 24*a* of the engine controller 24.

Responsive to the detection signal, the engine controller 24 performs control to cancel the automatic idling control which has been performed until that time. As a consequence, the speed of the engine 1 increases, for example, to a rated rpm suitable for the boom raising operation.

During these operations, the pressure developed in the second pilot line 19 is supplied to a valve actuator of the travel-controlling communication valve 16 via the signal line 26 so that the travel-controlling communication valve 16 is changed over into the communicating position. Nonetheless, the communication line 15 is maintained in a blocked state because the directional control valve 9 for the right travel motor is not operated. The pressure fluid of the first main pump 2 and the pressure fluid of the second main pump 3 are therefore supplied to an unillustrated boom cylinder via the first boom-controlling directional control valve 6 and the second boom-controlling directional control valve 8, respectively. Namely, by the combined pressure fluid from the first main pump 2 and the second main pump 3, the boom cylinder is driven to perform the boom raising operation as desired.

Let's also assume that to perform a combined arm-bucket operation, for example, the bucket-controlling directional control valve 7 and the arm-controlling directional control valve 10 are operated from their center positions mentioned above under (1). The pilot valves 7*a*,10*a* are then changed over in association with the directional control valves 7,10. Responsive to these change-over operations, a pressure rises in the part of the second pilot line 19, which is located downstream of the restrictor 31 in FIG. 1. This pressure is detected by the first pressure sensor 21 via the line 20*b* and the shuttle valve 20, and is outputted as a detection signal to the OR circuit 24*a* of the engine controller 24.

Responsive to the detection signal, the engine controller 24 performs control to cancel the automatic idling control which has been performed until that time. As a consequence, the speed of the engine 1 increases to a rpm suitable for the combined arm-bucket operation.

During these operations, the pressure developed in the second pilot line 19 is supplied to the valve actuator of the travel-controlling communication valve 16 via the signal line 26 so that the travel-controlling communication valve 16 is changed over into the communicating position. Nonetheless, the communication line 15 is maintained in a blocked state because the directional control valve 9 for the right travel motor is not operated. As a consequence, the pressure fluid of the first main pump 2 is supplied to the unillustrated bucket cylinder via the bucket-controlling directional control valve 7 and the pressure fluid of the second main pump 3 is supplied to the unillustrated arm cylinder via the arm-controlling directional control valve 10, whereby the combined bucket-arm operation is performed as desired.

(4) Combined operation of travelling and an operation involving drive of another actuator:

Let's now assume that to perform a combined travelling-arm operation, for example, the directional control valve 5 for the left travel motor, the directional control valve 9 for the right travel motor and the arm-controlling directional control valve 10 are operated from their center positions mentioned above under (1). The pilot valves 5*a*,9*a*,10*a* are then changed over in association with the directional control valves 7,9,10. Responsive to these change-over operations, pressures rise in the first and second pilot lines 18,19. These pressures are supplied to the shuttle valve 20 via the restrictors 30,31 in FIG. 1, respectively. The higher one of these pressures is detected by the first pressure sensor 21 and is then outputted as a detection signal to the OR circuit 24*a* of the engine controller 24.

Responsive to the detection signal, the engine controller 24 performs control to cancel the automatic idling control which has been performed until that time. As a consequence, the speed of the engine 1 increases to a rpm suitable for the combined travelling-arm operation.

During these operations, the pressure developed in the second pilot line 19 is supplied to the valve actuator of the travel-controlling communication valve 16 via the signal line 26 so that the travel-controlling communication valve 16 is changed over into the communicating position. As a consequence, the pressure fluid of the first main pump 2 is supplied to the directional control valve 5 for the left travel motor and also to the directional control valve for the right travel motor via the communication line 15 and the travel-controlling communication valve 16, and further to the unillustrated corresponding travel motors arranged in the pair. On the other hand, the pressure fluid of the second main pump 3 is supplied to the unillustrated arm cylinder via the arm-controlling directional control valve 10. The combined travelling-arm operation is therefore performed as desired.

(5) Single operation of revolving operation, earth-moving operation or offset operation:

Let's assume that to perform a single operation of revolving, for example, the revolving-controlling directional control valve 13 is operated from its center position mentioned above under (1). The pilot valve 13*a* is then changed over in association with the directional control valve 13. Responsive to this change-over operation, a pressure rises on a downstream side of the restrictor 32 in FIG. 1. This pressure is detected by the second pressure sensor 23 via the line 23*a*, and is outputted as a detection signal to the OR circuit 24*a* of the engine controller 24.

Responsive to the detection signal, the engine controller 24 performs control to cancel the automatic idling control which has been performed until that time. As a consequence, the speed of the engine 1 increases to a rpm suitable for the revolving operation.

The pressure fluid of the third main pump 4 is then supplied to the revolving-controlling directional control valve 13 and further to the unillustrated revolving motor, whereby the revolving operation is performed as desired.

Let's next assume that to perform a single operation of earth moving or a single operation of offset, for example, the blade-controlling directional control valve 12 or the offset-controlling directional control valve 14 is operated from its center position mentioned above under (1). The pilot valve 12*a* or 14*a* is then changed over in association with the directional control valve 12 or 14. Responsive to this change-over operation, a pressure rises on a downstream side of the restrictor 32 in FIG. 1 as mentioned above. This pressure is detected by the second pressure sensor 23 via the line 23*a*, and is outputted as a detection signal to the OR circuit 24*a* of the engine controller 24.

Responsive to the detection signal, the engine controller 24 performs control to cancel the automatic idling control which has been performed until that time. As a consequence, the speed of the engine 1 increases to a rpm suitable for the earth-moving operation or the offset operation.

The pressure fluid of the third main pump 4 is then supplied to the blade-controlling directional control valve 13 or the offset-controlling directional control valve 14 and further to the unillustrated blade-driving cylinder or offset cylinder, whereby the earth-moving operation or the offset operation is performed as desired.

(6) Combined operation of revolving and an operation involving drive of another actuator:

Let's assume that to perform a combined operation of revolving and boom raising, for example, the revolving-controlling directional control valve 13, the first boom-controlling directional control valve 6 and the second boom-controlling directional control valve 8 are operated from their center positions mentioned above under (1). The pilot valves 13*a*,6*a*,8*a* are then changed over in association with the directional control valves 13,6,8. Responsive to these change-over operations, pressures rise on downstream sides of the restrictors 32,31 in FIG. 1. These pressures are detected by the first pressure sensor 21 and the second pressure sensor 23, respectively, and are outputted as detection signals to the engine controller 24.

Responsive to the detection signals, the engine controller 24 performs control to cancel the automatic idling control which has been performed until that time. As a consequence, the speed of the engine 1 increases to a rpm suitable for the combined operation of revolving and boom raising.

During these operations, the pressure developed in the second pilot line 19 is supplied to the valve actuator of the travel-controlling communication valve 16 via the signal line 26 so that the travel-controlling communication valve 16 is changed over into the communicating position. Nonetheless, the communication line 15 is maintained in a blocked state because the directional control valve 9 for the right travel motor is not operated. The pressure fluid of the first main pump 2 and the pressure fluid of the second main pump 3 are therefore supplied to the unillustrated boom cylinder via the first boom-controlling directional control valve 6 and the second boom-controlling directional control valve 8, respectively. Namely, by the combined pressure fluid from the first main pump 2 and the second main pump 3, the boom cylinder is driven to perform the boom raising operation as desired.

Further, the pressure fluid of the third main pump 4 is supplied to the unillustrated revolving motor via the revolving-controlling directional control valve 13, so that the revolving operation is performed as desired.

(7) Combined operation of a earth-moving operation and an operation involving drive of another actuator:

Let's assume that to perform a combined operation of earth moving and straight advance travelling, for example, the blade-controlling directional control valve 12, the directional control valve 5 for the right travel motor and the directional control valve 9 for the left travel motor are operated from their center positions mentioned above under (1). The pilot valves 12*a*,5*a*,9*a* are then changed over in association with the directional control valves 12,5,9. Responsive to these change-over operations, pressures rise on downstream sides of the restrictors 30,32 in FIG. 1. These pressures are detected by the first pressure sensor 21 and the second pressure sensor 23, respectively, and are outputted as detection signals to the OR circuit 24*a* of the engine controller 24.

Responsive to the detection signals, the engine controller 24 performs control to cancel the automatic idling control which has been performed until that time. As a consequence, the speed of the engine 1 increases to a rpm suitable for the combined operation of earth moving and straight advance travelling.

During these operations, pressure which is sufficient to change over the travel-controlling communication valve 16 is not guided to the signal line 26 because no pressure is developed in the second pilot line 19. Accordingly, the communication line 15 is maintained in a state cut off by the travel-controlling communication valve 16. As a consequence, the pressure fluid of the first main pump 2 is supplied to the unillustrated left travel motor via the directional control valve 5 for the left travel motor and the pressure fluid of the second main pump 3 is supplied to the unillustrated right travel motor via the directional control valve 9 for the right travel motor, whereby the straight advance travelling is performed as desired.

Further, the pressure fluid of the third main pump 4 is supplied to the unillustrated blade cylinder via the blade-controlling directional control valve 12, so that the earth-moving operation is performed as desired.

Accordingly, the combined operation of earth moving and straight advance travelling is performed as described above.

(8) Combined operation of an offset operation and an operation involving drive of another actuator:.

Let's assume that to perform a combined operation of offset and boom raising, for example, the offset-controlling directional control valve 14, the first boom-controlling directional control valve 6 and the second boom-controlling directional control valve 8 are operated from their center positions mentioned above under (1). The pilot valves 14*a* ,6*a*,8*a* are then changed over in association with the directional control valves 14,6,8. Responsive to these change-over operations, pressures rise on downstream sides of the restrictors 32,31 in FIG. 1. These pressures are detected by the first pressure sensor 21 and the second pressure sensor 23, respectively, and are outputted as detection signals to the OR circuit 24*a* of the engine controller 24.

Responsive to the detection signals, the engine controller 24 performs control to cancel the automatic idling control which has been performed until that time. As a consequence, the speed of the engine 1 increases to a rpm suitable for the combined operation of offset and boom raising.

During these operations, the pressure developed in the second pilot line 19 is supplied to the valve actuator of the travel-controlling communication valve 16 via the signal line 26 so that the travel-controlling communication valve 16 is changed over into the communicating position. Nonetheless, the communication line 15 is maintained in a blocked state because the directional control valve 9 for the right travel motor is not operated. The pressure fluid of the first main pump 2 and the pressure fluid of the second main pump 3 are therefore supplied to the unillustrated boom cylinder via the first boom-controlling directional control valve 6 and the second boom-controlling directional control valve 8, respectively. Namely, by the combined pressure fluid from the first main pump 2 and the second main pump 3, the boom cylinder is driven to perform the boom raising operation as desired.

Further, the pressure fluid of the third main pump 4 is supplied to the unillustrated offset cylinder via the offset-controlling directional control valve 14, so that the offset operation is performed as desired. Accordingly, the combined operation of offset and boom raising is performed as described above.

Incidentally, combined operations making combined use of actuators other than those described above can also be performed in a similar manner as in any one of the above-described combined operations.

In the embodiment constructed as described above, there are arranged, as mentioned above, the communication line 15, through which the input port of the directional control valve 5 for the left travel motor and the input port of the directional control valve 9 for the right travel motor are communicated with each other, and the travel-controlling communication valve 16 which can hold the communication line 15 in either the communicating position or the cutoff position. This travel-controlling communication valve 16 is designed to be changed over into the communicating position when any one of directional control valves for other actuators connected to the first main pump 2, specifically the first boom-controlling directional control valve 6 and the bucket-controlling directional control valve is changed over or when any one of directional control valves for other actuators connected to the second main pump 3, specifically the second boom-controlling directional control valve 8, the arm-controlling directional control valve 10 and the directional control valve 11 for the reserve actuator is changed over. Therefore, upon combined operation of travelling and an operation involving another actuator, the pressure fluid delivered from the first main pump 2 is supplied to the paired travel motors via the directional control valve 5 for the left travel motor and the directional control valve 9 for the right travel motor, and the pressure fluid delivered from the second main pump 3 is supplied to the above-mentioned another actuator. The travelling operation can therefore be performed without being affected by drive of other actuator or actuators or by fluctuations or the like in load pressure. Even during a combined operation of travelling and an operation involving another actuator, independence can hence be assured for the travelling without causing a zigzag movement. As a consequence, work can be achieved with high accuracy.

Further, the shuttle valve 20 is arranged to select the higher one of a pressure in the first pilot line 18 and a pressure in the second pilot line 19. This has made it possible to achieve the detection of the pressure in the first pilot line 18 and that of the pressure in the second pilot line 19 by arranging only one pressure sensor 21.

In addition, the third main pump 4 is arranged, to which the revolving-controlling directional control valve 13 is connected. Upon performing a combined operation of revolving and a boom, arm, bucket or travelling operation as mentioned above, it is therefore possible to supply the pressure fluid of the third main pump 4 to the unillustrated revolving motor via the revolving-controlling directional control valve 13 and then to drive the revolving motor independently of drive of other actuator or actuators or fluctuations in load pressure. Independence can therefore be assured for the revolving operation.

The blade-controlling directional control valve 13 and the offset-controlling directional control valve 14 are connected to the third main pump 4. Upon performing a combined operation of an earth-moving operation or offset operation and an operation such as a travelling, boom or arm operation as mentioned above, it is similarly possible to supply the pressure fluid of the third main pump 4 to the unillustrated blade-driving cylinder or the unillustrated offset cylinder via the blade-controlling directional control valve 13 or the offset-controlling directional control valve 14 and then to drive the blade-driving cylinder or the offset cylinder independently of drive of other actuator or actuators or fluctuations in load pressure. Independence can therefore be assured for the earth-moving operation or the offset operation.

In the above-mentioned embodiment, the directional control valve 5 for the left travel motor, the first boom-operating directional control valve 6 and the bucket-controlling directional control valve 7 are connected to the side of the first main pump 2, and the second boom-controlling directional control valve 8, the directional control valve 9 for the right travel motor, the arm-controlling directional control valve 10 and the directional control valve 11 for the reserve actuator are connected to the side of the second main pump 3. It is however to be noted that the directional control valves for such other actuators can be connected in various combinations to the first main pump 2 and the second main pump 3. For example, it is possible to adopt such a construction that only one boom-controlling directional control valve is arranged for controlling drive of the boom cylinder, the directional control valve 5 for the left travel motor, the above-mentioned boom-controlling directional control valve and the arm-controlling directional control valve are connected to the first main pump 2, and one or more of directional control valves for other actuator such as the bucket cylinder are connected along with the directional control valve 9 for the right travel motor to the second main pump 3. An engine speed control system constructed as described above can exhibit similar advantageous effects as the above-described embodiment.

Owing to the construction as described above, the present invention according to any one of the first to sixth aspects thereof can assure independence of travelling while making it possible to achieve automatic idling control, which automatically sets the engine speed at a predetermined low rpm, and also cancellation of the automatic idling control. During a combined operation of travelling and one or more of operations involving other actuators, no zigzag movement takes place. Compared with the conventional art, work can therefore be achieved with excellent accuracy. In particular, the present invention according to the fourth aspect thereof can assure independence for revolving during a combined operation of the revolving and one or more of operations involving other actuators.

Further, the present invention according to the fifth aspect thereof can assure independence for an earth-moving operation during a combined operation of the earth-moving operation and one or more of operations involving other actuators.

Moreover, the present invention according to the sixth aspect thereof can assure independence for an offset operation during a combined operation of the offset operation and one or more of operations involving other actuators.

This application claims the priority of Japanese Patent Application No. HEI 10-147505 filed May 28, 1998, which is incorporated herein by reference.

What is claimed is:

1. An engine speed control system for a construction machine, said system being for arrangement in association with a hydraulic circuit of said construction machine, said hydraulic circuit being provided with an engine, plural main hydraulic pumps driven by said engine, plural actuators driven by hydraulic fluid supplied from said main hydraulic pumps, and directional control valves for controlling flows of the hydraulic fluid to be supplied from said main hydraulic pumps to said actuators, respectively, in which:

said plural actuators comprises a pair of travel motors and plural other actuators different from said travel motors, said directional control valves comprises a first directional control valve for controlling drive of one of said pair of travel motors, a second directional control valve for controlling drive of the other one of said pair of travel motors and plural third directional control valves for controlling drive of said plural other actuators, predetermined ones of said first directional control valve and plural third directional control valves are connected to a first one of said plural main hydraulic pumps, and other ones of said second directional control valve and plural third directional control valves are connected to a second one of said plural main hydraulic pumps, said system being provided with an engine controller capable of controlling a speed of said engine, a pilot pump capable of supplying a pilot pressure, a pilot line for guiding said pilot pressure supplied from said pilot pump, pilot valves arranged in said pilot line in association with said directional control valves, respectively, such that said pilot valves are operated association with their corresponding directional control valves, and a pressure detection device for detecting a pressure developed in said pilot line upon change-over of at least one of said pilot valves and then outputting a detection signal to said engine controller, whereby based on the detection signal outputted from said pressure detection device, said engine controller performs automatic idling control to maintain said speed of said engine at an idling speed of a predetermined low rpm or performs control to cancel said automatic idling control, wherein:

said hydraulic circuit of said construction machine is provided further with a communication line, through which an input port of said first directional control valve and an input port of said second directional control valve are connected with each other, and also with a travel-controlling communication valve capable of maintaining said communication line in either a communicating state or a cutoff state, said pilot line comprises a first pilot line and a second pilot line, said first pilot line is provided with said pilot valve operable in association with said first directional control valve and also with said pilot valve operable in association with said second directional control valve, said second pilot line is provided with said pilot valves operable in association with their corresponding ones of said plural third directional control valves for controlling the drive of said plural other actuators, respectively, a signal line for guiding a pressure, which is developed in said second pilot line, as a change-over pressure for said travel-controlling communication valve, and said travel-controlling communication valve has a changed-over position where, when said change-over pressure is guided to said signal line, said communication line is maintained in said communicating state.

2. The engine speed control system according to claim 1, wherein:

said system further comprises a higher pressure selection device capable of selecting higher one of a pressure in said first pilot line and a pressure in said second pilot line; and said pressure detection device detects a pressure outputted from said higher pressure selection device.

3. The engine speed control system according to claim 1, wherein:

said plural other actuators comprise a first boom cylinder, a second boom cylinder, a bucket cylinder and an arm cylinder;

said plural third directional control valves comprise a first-boom-controlling directional control valve for controlling drive of said first boom cylinder, a second-boom-controlling directional control valve for controlling drive of said second boom cylinder, a bucket-controlling directional control valve for controlling drive of said bucket cylinder, and an arm-controlling directional control valve for controlling drive of said arm cylinder;

said first-boom-controlling directional control valve and said bucket-controlling directional control valve are connected to said first main pump; and said second-boom-controlling directional control valve and said arm-controlling directional control valve are connected to said second main pump.

4. The engine speed control system according to claim 1, wherein:

said plural main pumps further comprise a third main pump;

said plural other actuators further comprise a revolving motor driven by pressure fluid delivered from said third main pump, and said plural third directional control valves further comprise a revolving-motor-controlling directional control valve for controlling drive of said revolving motor; and said pilot line further comprises a third pilot line, and is additionally provided with a pilot valve arranged in said third pilot line such that said pilot valve is operated in association with said revolving-motor-controlling directional control valve and also with an additional pressure detection device for detecting a pressure, which is developed in said third pilot line upon change-over of said pilot valve, and then outputting the pressure as a detection signal to said engine controller.

5. The engine speed control system according to claim 4, wherein:

said plural other actuators further comprise a blade-driving cylinder, and said plural third directional control valves further comprise a blade-controlling directional control valve for controlling drive of said blade-driving cylinder; and said blade-controlling directional control valve is connected to said third main pump.

6. The engine speed control system according to claim 4, wherein:

said plural other actuators further comprise an offset cylinder, and said plural third directional control valves further comprise an offset-cylinder-controlling directional control valve for controlling drive of said offset cylinder; and said offset-cylinder-controlling directional control valve is connected to said third main pump.

7. The engine speed control system according to claim 1, wherein said construction machine is a hydraulic excavator.

* * * * *